United States Patent [19]

McGrail

[11] Patent Number: 4,491,989

[45] Date of Patent: Jan. 8, 1985

[54] CLOSURE DEVICE FOR TOILET SEATS

[76] Inventor: John F. McGrail, 7701 Warner, Apt. C197, Huntington Beach, Calif. 92647

[21] Appl. No.: 595,688

[22] Filed: Apr. 2, 1984

[51] Int. Cl.[3] ..... A47K 13/10

[52] U.S. Cl. ..... 4/251; 4/250

[58] Field of Search ..... 4/251, 250, 253, 661

[56] References Cited

U.S. PATENT DOCUMENTS

| | | | |
|---|---|---|---|
| 1,257,331 | 2/1918 | Duff | 4/251 |
| 2,011,404 | 8/1935 | Gihasso | 4/251 |
| 2,200,687 | 5/1940 | Bercot | 4/251 X |
| 3,284,810 | 11/1966 | Stokes | 4/251 |
| 3,316,561 | 5/1967 | Newkirk | 4/251 |
| 3,404,411 | 10/1968 | Newkirk | 4/251 |
| 3,781,924 | 1/1974 | Davis, Jr. | 4/251 |

FOREIGN PATENT DOCUMENTS

| | | | |
|---|---|---|---|
| 297187 | 7/1927 | United Kingdom | 4/251 |

*Primary Examiner*—Henry K. Artis

*Attorney, Agent, or Firm*—Francis X. LoJacono

[57] ABSTRACT

The invention discloses a closure and hinge device that automatically releases and lowers a toilet seat, or the seat and its associated lid together, when the flushing handle of a commode or toilet is actuated. The device includes a releasable hinge-closing mechanism having a spring-biased latching lever and a dampening device mounted to the toilet lid, the device being positioned to be engaged by the latching lever. When the latching lever is actuated by the flushing of the commode, the seat or the seat and lid together are released and will move downwardly in a controlled manner by means of the dampening device. A latching pawl is located between the lid-hinge member and the seat, whereby the seat and lid are coupled together when in a raised position so as to be lowered together upon being released.

9 Claims, 9 Drawing Figures

CLOSURE DEVICE FOR TOILET SEATS

BACKGROUND OF THE INVENTION

1. Field of the Invention

This invention relates generally to toilet seats and lids and their related hinge mechanisms, and more particularly tc a closure device that automatically lowers a fully raised toilet lid, or both the lid and associated seat, in a controlled manner when the user thereof actuates the flushing handle.

2. Description of the Prior Art

Various problems and difficulties have been encountered in providing suitable means for hinging a toilet lid and seat so that they can be automatically lowered together, or the lid by itself.

Many types of toilet-seat units and attachments are disclosed in numerous patents. However, these devices generally have features that restrict their use; and they are generally complicated to operate and very expensive to manufacture and maintain in a continuous mode of operation. Such devices can be found in the following United States patents.

U.S. Pat. No. 1,099,801 discloses a lavatory attachment designed to move under a person's weight, and to automatically actuate the cover or seat when the weight of the user is applied to a fulcrumed platform interconnected to the seat by means of levers.

U.S. Pat. No. 1,632,819 discloses a seat-actuating means for sanitary closets that is controlled by a foot-pedal-actuating means having a recoil spring to eliminate the noise caused by the seat contacting the rim portion of the toilet bowl.

U.S. Pat. No. 1,863,682 also discloses an actuator that controls the toilet seat, its cover and flushing valve by means of a foot-control pedal which is positioned at one side and near the forward portion of the base of the toilet receptacle. The pedal is interconnected to a gear-and-racket device connected to the toilet-seat hinge pin and water-release valve.

U.S. Pat. No. 2,200,687 discloses a means for closing the seat and cover, and at the same time actuating the flushing valve This device includes a pair of cushioning cylinders for dampening the fall of the seat and the cover.

U.S. Pat. No. 2,219,044 discloses a toilet-seat arrangement wherein after use the seat is covered, washed, sterilized by heat, and then cooled, so as to be in a clean and sterile condition, and closed after each operation.

U.S. Pat. Nos. 1,257,331; 2,300,936; 3,284,810; 3,316,561; 3,404,411; 3,781,924; 4,195,372 and 4,338,690 are also related to the subject matter of the present application, each one having its own particular arrangement for controlling the flushing and/or raising and lowering of the toilet seat and associated lid or cover.

SUMMARY OF THE INVENTION

The present invention has for an important object to provide a suitable apparatus for lowering a toilet cover and seat, either singularly or together, by means of the flushing handle of the water closet of a typical commode or toilet.

Another object of the invention is to provide an automatic cover-and-seat-actuating device that lowers them to a closed position each time the toilet is flushed, so as to prevent inconvenience to a subsequent user thereof, particularly with respect to female individuals who must use the seat in a down position, and since male individuals especially very often leave the toilet seat in an up position after use.

A further object of the present invention is to provide an apparatus of this type that is incorporated as part of the hinge mechanism attached between the toilet bowl, the toilet lid, and its associated seat.

A still further object of the present invention is to provide a device of this character wherein the toilet cover or lid can be manually raised separately from the seat, or the cover and the seat can be manually raised together so as to be coupled in an upright position, the present device thus allowing the cover to be lowered, or the cover together with the seat portion lowered,when the flush handle is actuated for flushing the toilet.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only, and wherein identical reference numerals are used to refer to like parts in the various views.

DESCRIPTION OF THE PREFERRED EMBODIMENT

Figure 1:
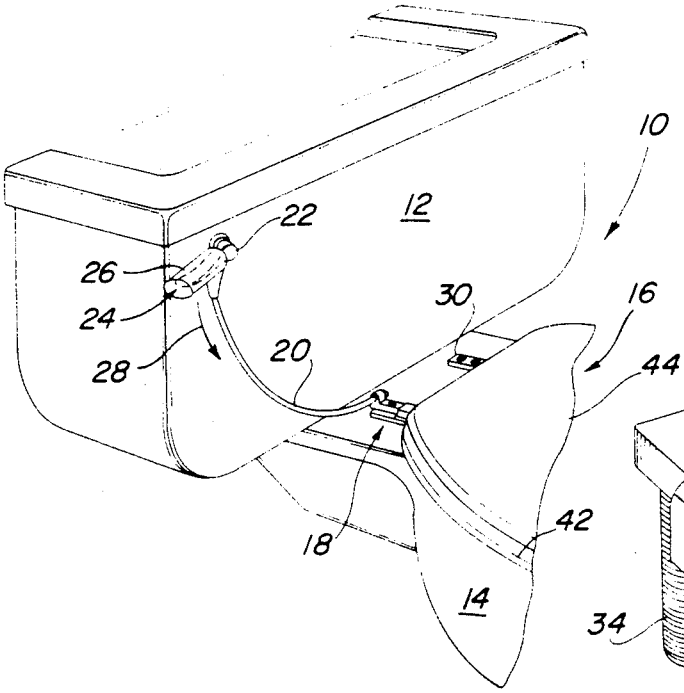
FIG. 1 is a perspective view of a typical commode apparatus having a water closet, a bowl, and a hinged seat unit, including the present invention which is adapted to operate the seat from an open mode to a closed mode, as shown therein.
Figure 7:
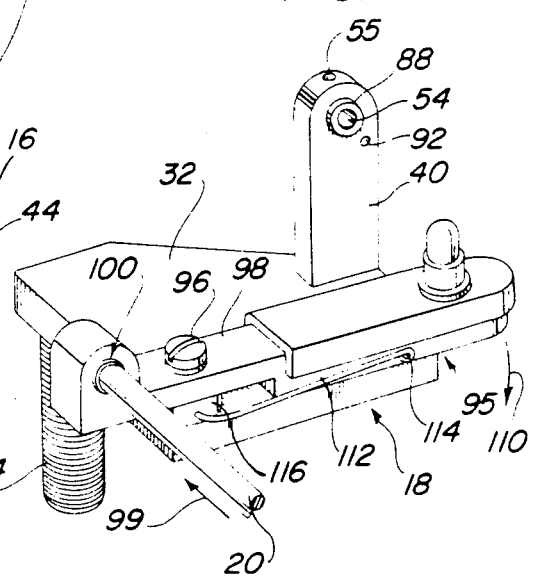
FIG. 7 is a perspective view of the hinge-latching mechanism.
Figure 2:
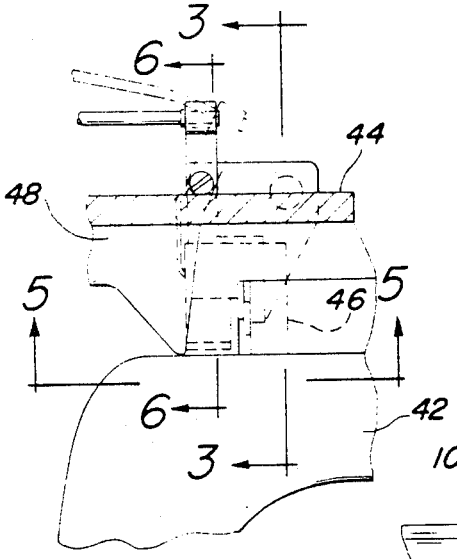
FIG. 2 is a partial top-plan view of the toilet-seat cover in an upright position, and the seat in a down position.

Referring more particularly to FIG. 1, there is shown a typical commode or toilet apparatus, generally indicated at 10, having a water closet 12 mounted on toilet bowl 14. Mounted to toilet bowl 14 is a toilet-seat unit, designated generally at 17, hinged to the bowl by the present invention, an automatic hinge-closing device, indicated at 18. The hinge closing device includes a connecting means such as cable or rod 20 which is adapted to be attached to the flushing handle 22 by a suitable attaching means 24. As an example of a suitable attaching means, one end of cable 20 is secured to a sleeve fitting 26 which is force-fitted over handle 22. Thus, as handle 22 is actuated in a downward direction, indicated by arrow 28, cable or rod 20 will in turn actuate the release mechanism of the hinge-closing device 18. It should be noted that only one such hinge device is required, and that the opposite hinge means 30 can be of any suitable type or in any configuration compatible with the present invention.

Figure 3:
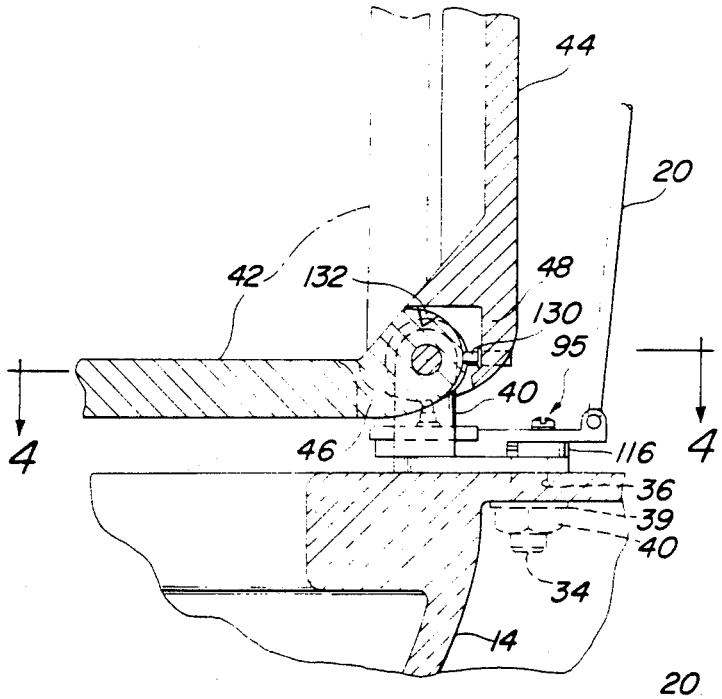
FIG. 3 is an enlarged cross-sectional view taken substantially along line 3—3 of FIG. 2.

The hinge device comprises a hinge-base member 32 including a depending threaded stud 34 which is received and bolted in the common hole 36 found at the rear of bowl 14, as seen in FIG. 3, wherein a typical nut and washer 38 and 39 are respectively provided. Base member 32 is formed having an upright, extended, hinge leg 40 which is positioned and adapted to hingedly support the toilet seat 42 and its associated cover or lid 44. Toilet seat 42 is provided with a hinge member defined by ear 46, the cover or lid 44 having an adjacent hinge member 48. Seat-hinge member 46 is mounted to hinge leg 40 so as to be freely rotated about the fixed hinge pin 50, the seat hinge 46 being held thereon by cap screw 52, and hinge pin 50 being fixedly secured in bore 54 of hinge leg 40 by set screw 56 which passes through aligned bores 55 and 57. Bore 55 is a threaded hole in the top of leg 40, and bore 57 is a hole formed in hinge pin 50, both bores being adapted to receive set screw 56. However, cover 44 is indirectly attached to hinge leg 40 and hinge pin 50 by means of a dashpot or dampener means 60, the hinge pin forming a valve means in dampener means 60.

Figure 4:
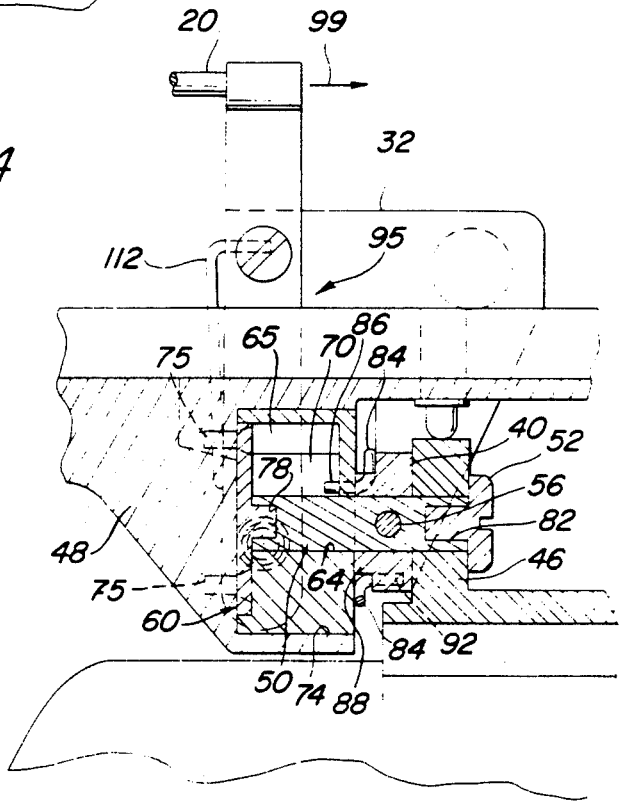
FIG. 4 is a cross-sectional view taken substantially along line 4—4 of FIG. 3.
Figure 5:
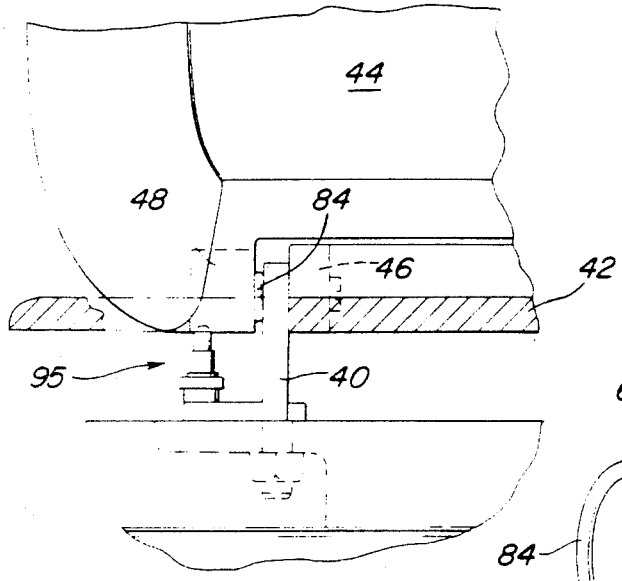
FIG. 5 is a front-elevational view of that of FIG. 2 taken substantially along line 5—5 of FIG. 2.
Figure 9:
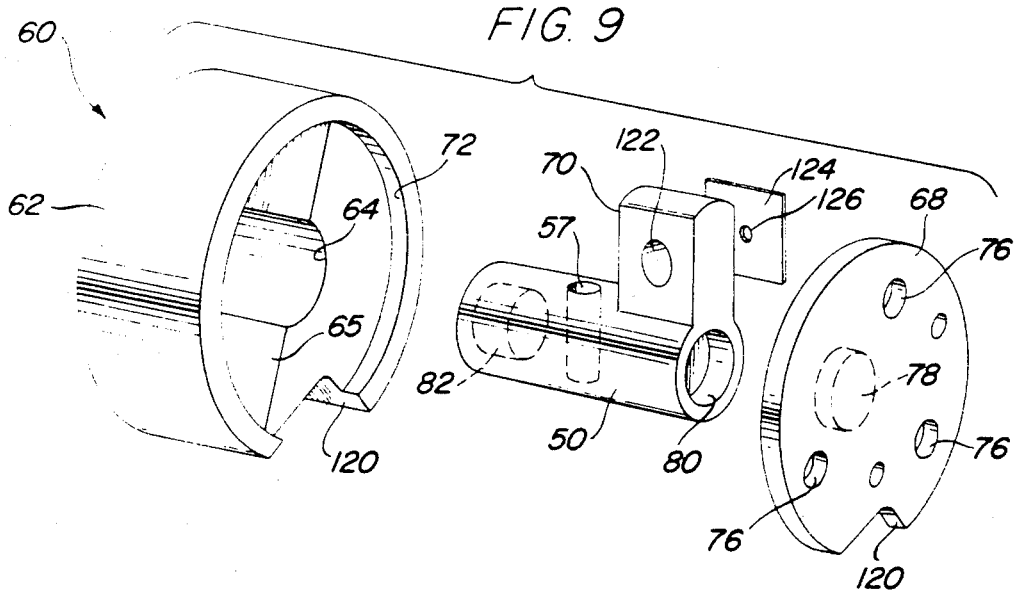
FIG. 9 is an exploded perspective view of the dampener means.

Dampener means 60 comprises a cylindrical housing 62 having a central bore 74 formed therein and including a semicircular chamber 65 closed at one end by housing wall 66 and at the other end by circular plate 68. As seen in FIG. 9, hinge pin 50 is positioned through bore 64 of housing 62 whereby a finger member 70 is formed as an integral part of the hinge pin, thus defining a partition to divide chamber 65 into two sections **65*a* and 65*b*. Accordingly, plate 68 is fixedly sealed to housing 62 in the matching circular recess 72, after plate 68 is secured to hinge member 48 in hinge cavity 74 by screws 75 which pass through screw holes 76 in plate 68. Pin 50 is supported at one end by bearing hub 78 which is received in recess bore 80 of pin 50, the opposite end of pin 50 being provided with a threaded bore 82 to receive cap screw 52, as seen in FIG. 4**.

Figure 6:
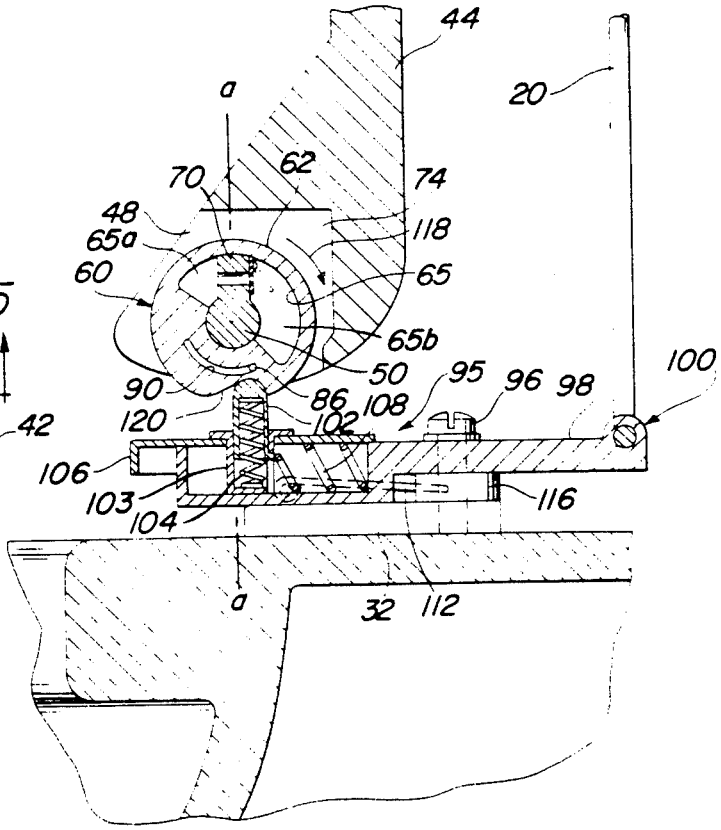
FIG. 6 is an enlarged cross-sectional view taken along line 6—6 of FIG. 2, showing the cover of the seat unit being held in an upright position.
Figure 8:
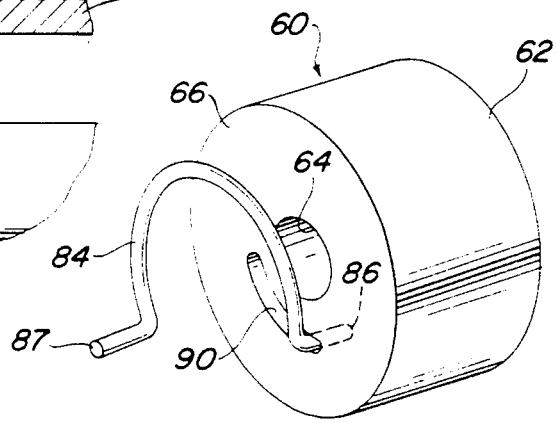
FIG. 8 is a perspective view of the dampener means used to control the lowering of the seat cover, or the seat together with the cover.

Interposed between hinge leg 40 and wall 66 of housing 62 is a spring means 84 which is formed in an arcuate or circular manner so as to have oppositely disposed projecting ears 86 and 87. Spring 84 is supported on an annular boss member 88 formed on leg 40, whereby ear 86 projects through arcuate slot 90 formed in wall 66 of housing 62, as seen in FIG. 8, the ear 87 projecting into bore 92 of leg 40. Thus, as cover 44 is rotated to an up-right open position, as shown in FIGS. 3 and 6, spring 84 is placed under compression. That is, when in a fully open mode, cover 44 will remain in an open position because its weight is borne rearwardly of the rotational center line a—a, as indicated in FIG. 6. Therefore, a forward rotational force is required to move seat cover 44 back past center line a—a.

In order to releasably secure or hold seat cover 44 in an upright position against the compressed force of spring 84, there is provided a hinge-release means, generally indicated at 95, which is pivotally mounted to hinge base 32 by a pin or screw 96 threaded to the hinge base. Hinge-release means 95 comprises a lever-arm member 98 through which screw 96 is received. Screw 96 defines a point at which lever arm 98 pivots in a horizontal plane, the lever extending rearwardly to provide an attaching means 100 for one end of cable or rod 20. The forward end of lever 98 extends forwardly of screw pin 96 and is adapted to support a pawl 102 which is spring-loaded in two directions, the pawl being formed having a housing 103 with a vertical spring 104 disposed therein to establish an upward force. Pawl 102 is supported in a fitting 106 slidably mounted to lever 98 which is biased forwardly by spring 108. Thus, hinge-release means 95 is actuated whenever flush handle 22 is forced downwardly in the usual manner. Cable or rod 20 moves in the direction of arrow 99, thus causing lever 98 to rotate about pivot screw 96, whereby pawl 102 is moved outwardly in an arcuate direction of arrow 110. In order to provide a return-actuator means, a biasing-spring member 112 is attached to the forward portion of lever 98 at 114 and at its opposite end to boss member 116 which is part of base 32.

When both seat 42 and lid or cover 44 are in a down and closed mode, as seen in FIG. 1, housing 62 of dampener means 60 is rotated with the lid, whereby valve partition 70 of hinge pin 50 is located at the rear of chamber 65, so as to provide an enlarged chamber section **65*a* and a very small chamber section 65*b*. As the seat lid is raised, housing 62 is rotated with cover 44 in the direction of arrow 118, whereby pawl 102 rides along the annular outer surface of housing 62, until the toilet lid is in its fully opened position. At this time, pawl 102 snaps into recesses 120 which are also formed in plate 68. Hence, lid 44 is locked in an open position or mode. Also, at this time, spring 84 has been loaded so as to provide a force to urge lid 44 closed. However, as the lid is raised and the housing 62 rotates, valve partition 70 is relocated to a forward position within chamber 65. This is accomplished by a check-valve means, the valve partition 70 being a member thereof. That is, partition 70 is provided with a passage or bore 122 and a flap-valve member 124, the flap valve being affixed to partition 70 on the side that is disposed in chamber section 65*b*. It should be particularly noted that flap valve 124 includes a very small centrally disposed, flow-control aperture 126. As the seat lid is raised, air from chamber section 65*a* passes readily into chamber section 65*b*, and remains there until the lid is released by the disengagement of pawl 102 as the handle 22 is actuated. Accordingly, when pawl 102 is released from recess 120 of housing 62, spring 84 will force lid 44 passed the center line a—a, at which time the downward movement of lid 44 will force air from chamber section 65*b* and then back into the chamber section, thus allowing the lid to close at a selective slow rate (determined by aperture 126) until it reaches its closed position against seat 42**.

However, when both lid 44 and seat 42 are raised, the seat will latch into an upright position together with the lid by means of a second pawl means 130. This pawl means is mounted in the rear hinge section of cover 44, as seen in FIG. 3, and rests against hinge member 46 of seat 42. When both the seat 42 and the lid 44 are in a raised mode, pawl 130 snaps into recess 132. Thus, the seat is now held in place with the lid, and will lower to a closed position with the lid when release means 95 is actuated as heretofore described.

While I have illustrated and described the preferred form of construction for carrying my invention into effect, this is capable of variation and modification without departing from the spirit and scope of the present invention. I, therefore, do not wish to be limited to the precise details of construction set forth, but desire to avail myself of such variations and modifications as come within the scope of the appended claims.

I claim:

1. An apparatus for automatically releasing a seat, or together a lid and a seat, for a toilet or a commode having a bowl, a water closet, and a flushing handle, wherein the apparatus comprises:

a releasable hinge-closing means mounted to said bowl of said toilet and to said lid and seat thereof, allowing said lid, or lid and seat, to be lowered from an open upright position to a closed horizontal position;

actuating means connected between said releasable hinge-closing means and flushing handle of said toilet, whereby said actuating means is releasably disengaged from said toilet lid;

dampening means mounted to said lid and adapted to be engaged with said releasable hinge-closing means, whereby the downward movement of said lid, or said lid and seat, from an open to a closed position is controlled thereby; and latching means interposed between said toilet lid and said toilet seat, whereby said seat is coupled to said lid when both are in an open upright position.

2. An apparatus as recited in claim 1, wherein said releasable hinge-closing means includes a biasing means to urge said toilet lid in a downward direction when said releasable hinge-closing means is disengaged from said dampening means.

3. An apparatus as recited in claim 2, wherein said releasable hinge-closing means comprises:

a hinge-base member adapted to be secured to said bowl;

a lever arm pivotally attached to said hinge-base member, and having an extended forward latching end and an oppositely extended connector end, said latching end adapted to engage or disengage said dampening means and said connector end being connected to said actuating means;

a return-actuator means attached between said hinge-base member and said forward latching end of said lever arm, whereby said lever arm is returned to a normally latched position after being disengaged from said dampening means; and a hinge-leg member extending upwardly from said hinge base so as to hingedly attach both said toilet lid and said toilet seat to said base.

4. An apparatus as recited in claim 3, wherein said latching end of said lever arm includes a spring-biased pawl member.

5. An apparatus as recited in claim 4, wherein said dampening means comprises a housing secured to said toilet lid at the rear hinge portion of said lid, so as to rotate therewith, said housing having an outer cylindrical surface in which is formed a recess adapted to receive said spring-biased pawl member of said lever arm.

6. An apparatus as recited in claim 5, wherein:

said housing of said dampening means is formed having a semicircular chamber;

said housing and said chamber are adapted to receive a fixed hinge pin therethrough;

said hinge pin is fixedly secured to said hinge-leg member; and said hinge pin defines a valve means disposed within said chamber to control the flow of air within said chamber.

7. An apparatus as recited in claim 6, wherein said valve means within said chamber comprises:

a partition having a passage therethrough; and a flap-valve member attached to one side of said partition, whereby said passage is covered to allow air to flow freely into one side of said chamber as said toilet lid is raised to an open position, said flap-valve including an aperture adapted to control the flow of air to the opposite side of said chamber as said toilet lid is lowered to a closed position.

8. An apparatus as recited in claim 7, wherein said actuating means comprises:

an elongated cable having one end connected to said connector end of said lever arm; and means secured to the opposite end of said cable to attach said cable to said flushing handle.

9. An apparatus as recited in claim 5, wherein said atching means interposed between said toilet lid and said toilet seat comprises:

a second spring-loaded pawl member mounted in said rear hinge portion of said toilet seat, and positioned to engage the rear hinge portion of said toilet seat; and a recess formed in said rear hinge portion of said toilet seat, and positioned to receive said second pawl member therein when said toilet seat is in an upright position with said toilet seat, whereby said toilet lid and said toilet seat are lowered together when said lever arm is actuated.

* * * * *